US009714783B2

(12) United States Patent
Maroli

(10) Patent No.: US 9,714,783 B2
(45) Date of Patent: Jul. 25, 2017

(54) EXTRUDED ICE MAKING MACHINE WITH EXTRUSION DIE SECURED WITHOUT SCREWS

(75) Inventor: Cesarino Maroli, Casorezzo (IT)

(73) Assignee: Brema Ice Makers S.P.A., Villa Cortese (MI) (IT)

( * ) Notice: Subject to any disclaimer, the term of this patent is extended or adjusted under 35 U.S.C. 154(b) by 474 days.

(21) Appl. No.: 14/232,846

(22) PCT Filed: Jul. 10, 2012

(86) PCT No.: PCT/IB2012/053519
§ 371 (c)(1),
(2), (4) Date: Jan. 14, 2014

(87) PCT Pub. No.: WO2013/011417
PCT Pub. Date: Jan. 24, 2013

(65) Prior Publication Data

US 2014/0245774 A1 Sep. 4, 2014

(30) Foreign Application Priority Data

Jul. 20, 2011 (EP) ..... 11425197

(51) Int. Cl.

| | |
|---|---|
| ***A23G 9/00*** | (2006.01) |
| ***F25C 1/10*** | (2006.01) |
| ***F25C 1/14*** | (2006.01) |
| *F25C 1/06* | (2006.01) |
| *F25C 5/00* | (2006.01) |
| *F25C 5/14* | (2006.01) |
| *F25C 1/04* | (2006.01) |

(52) U.S. Cl.
CPC ..... *F25C 1/10* (2013.01); *F25C 1/147* (2013.01); *F25C 1/04* (2013.01); *F25C 1/06* (2013.01); *F25C 5/00* (2013.01); *F25C 5/14* (2013.01)

(58) Field of Classification Search
CPC ..... F25C 1/04; F25C 5/14; F25C 5/00; F25C 1/10; F25C 1/06
See application file for complete search history.

(56) References Cited

U.S. PATENT DOCUMENTS

| | | | | |
|---|---|---|---|---|
| 4,497,184 A * | 2/1985 | Utter | ..... | F25C 1/147 100/117 |
| 4,741,173 A | 5/1988 | Newmann | | |
| 5,123,260 A | 6/1992 | Althoff et al. | | |
| 6,877,334 B2 * | 4/2005 | Hiramatsu | ..... | F25B 39/02 165/156 |

FOREIGN PATENT DOCUMENTS

| | | |
|---|---|---|
| EP | 495513 | 7/1992 |
| JP | H01 144 777 U | 10/1999 |

OTHER PUBLICATIONS

International Search Report and Written Opinion dated Jul. 17, 2013, issued in PCT Application No. PCT/IB2012/053519, filed Jul. 10, 2012.

* cited by examiner

*Primary Examiner* — David Teitelbaum
(74) *Attorney, Agent, or Firm* — Workman Nydegger

(57) ABSTRACT

A machine for making extruded ice obtained by passing a mass of ice in granules through an extrusion die (20) arranged at the end of a main cooled drum (4). The latter at one end has a flange (10) upon which a ring (14) clamping the die is fastened. Thus, screws for fastening the die to the main drum are not required, so that operations for the machine maintenance and for replacing the die are considerably facilitated.

15 Claims, 6 Drawing Sheets

EXTRUDED ICE MAKING MACHINE WITH EXTRUSION DIE SECURED WITHOUT SCREWS

BACKGROUND OF THE INVENTION

1. Field of the Invention

The present invention relates, in its broadest aspect, to industrial ice making machines, which means machines that are generally used for professional reasons, such as in public places (bars, restaurants and the like) for making ice with desired shapes and dimensions.

According to a more specific aspect, the present invention relates to ice making machines by extrusion through a die or draw plate.

2. Present State of the Art

As it is known, the shape that can be taken by the ice depends on applications and it can change from the usual cubes used for beverages, to more complex shapes such as nuggets, flakes or granules of ice; in this latter case it is mainly used for keeping food in the cool condition, such as fish or meat of refrigerated display boxes of supermarkets or restaurants.

In order to obtain such shapes and sizes of the product it is known to feed (that is to extrude) the ice through a die or draw plate, namely a suitably shaped body with channels, wherein the frozen mass coming from the evaporator is pushed by means of a mechanism that usually is an auger.

To this end such machines usually have an evaporator with a vertical axis where the water is lifted therein by a rotating auger within a main drum, that is cooled on the outside by the refrigerant; as the water is lifted in the main barrel, it gets cold and it tends to form the ice on the inner wall, which is then pushed towards the extrusion die arranged in the upper part of the evaporator.

The ice passes through the extrusion die or draw plate in the longitudinal direction forming rods, that are then crushed downstream of it by a dedicated device, thereby obtaining granules, flakes or other shapes and sizes of ice, depending on the characteristics of the rod-breaking device.

An example of an ice making machine made according to such principles, is known from the European patent application N. 495513 to Hoshizaki Denki. In this machine, as generally in all machines for making extruded ice, the critical member is the die or draw plate through which the ice formed within the main drum of the evaporator is pushed: the die has to compress the ice passing therethrough, conveying it then towards the rod-breaking device.

Therefore it is subjected to non negligible axial and tangential forces due to the ice being pushed therethrough and moreover, due to the fact that it is in communication upstream with the coldest area of the machine and downstream with the ice collecting tray that exchanges heat with the outer environment, it is subjected to thermal differences that can lead to stresses on the die and on the mouting means (bearings, bushings, etc.) inside the machine.

With reference to the above it has to be noted that the die is usually fastened to the upper part of the main barrel of the evaporator via radial dowels or screws, which penetrate therefore through its wall and are screwed at some teeth of the die, that to this end are provided with suitable threaded holes or seats.

It can be understood how holes for the fastening dowels or screws passing through the main barrel of the evaporator, weaken the structure thereof and are also possible points for the leakage of liquids; moreover, due to the fact that the screws have a different deformation with respect to the main drum of the evaporator, differential deformations can arise between them, thereby inducing such forces to make the fastening of the die as unstable, possibly causing also the screws or the thread thereof to be broken or however damaged.

It is most likely for such reason that in the above mentioned patent application the fastening screws engage into recesses provided along some teeth of the extrusion die: the thermal deformations, by means of such solution, can be compensated by clearances occurring between the screws and the aforesaid seats.

However, such a solution is not appropriate as it does not effectively help in axially stabilizing the die that, as described hereinbefore, is subjected to axial and tangential thrusts due to the forward motion of the produced ice from the auger.

Further, as it will be better explained below, the radial fastening of the extrusion die does not facilitate the operations for the maintenance of the ice making machine, which require the die to be removed in order to have access to the interior of the evaporator.

SUMMARY OF THE INVENTION

Therefore the present invention aims at overcoming the drawbacks described above, that characterize the known ice making machines.

That is to say that the technical problem at the basis of the invention is to arrange a machine for making extruded ice, having such characteristics from the structure and operation point of view to allow the extrusion die to be firmly and safely mounted; moreover, with reference to this problem the invention aims also at removing the provision of the holes passing through the main druml of the evaporator; a further aim is to permit the operations for disassembling and removing the die, such to facilitate the machine maintenance.

BRIEF DESCRIPTION OF THE DRAWINGS

Such drawback is solved by an ice making machine, whose characteristics are expressed in the following claims; such characteristics, the effects resulting therefrom and the advantages of the invention will be more clear from the following description with reference to an approximate example for making the machine according to the invention, shown in the annexed drawings wherein:

DETAILED DESCRIPTION OF THE PREFERRED EMBODIMENTS

Figure 1:
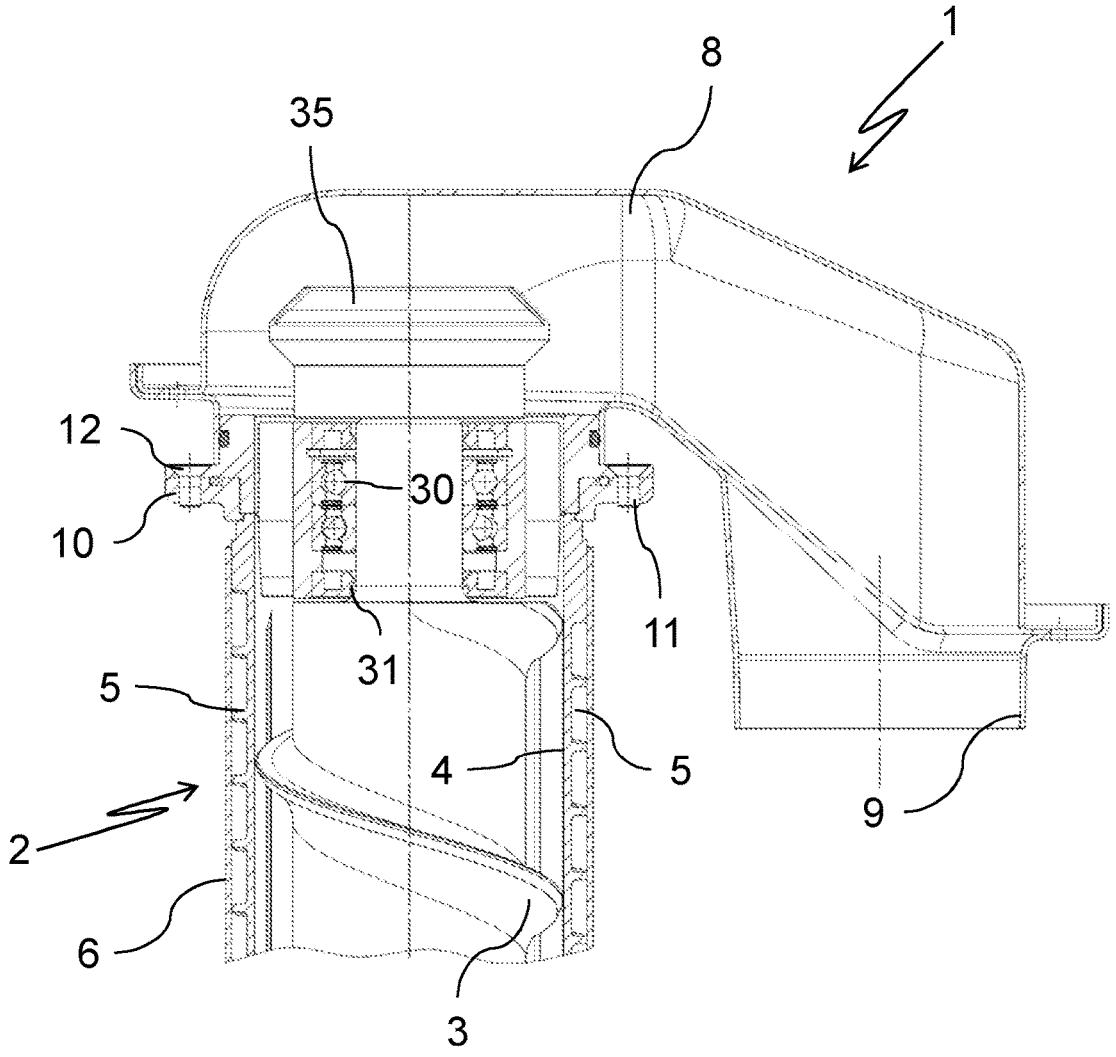
FIG. 1 is a sectional view of a part of the ice machine according to the invention.
Figure 2:
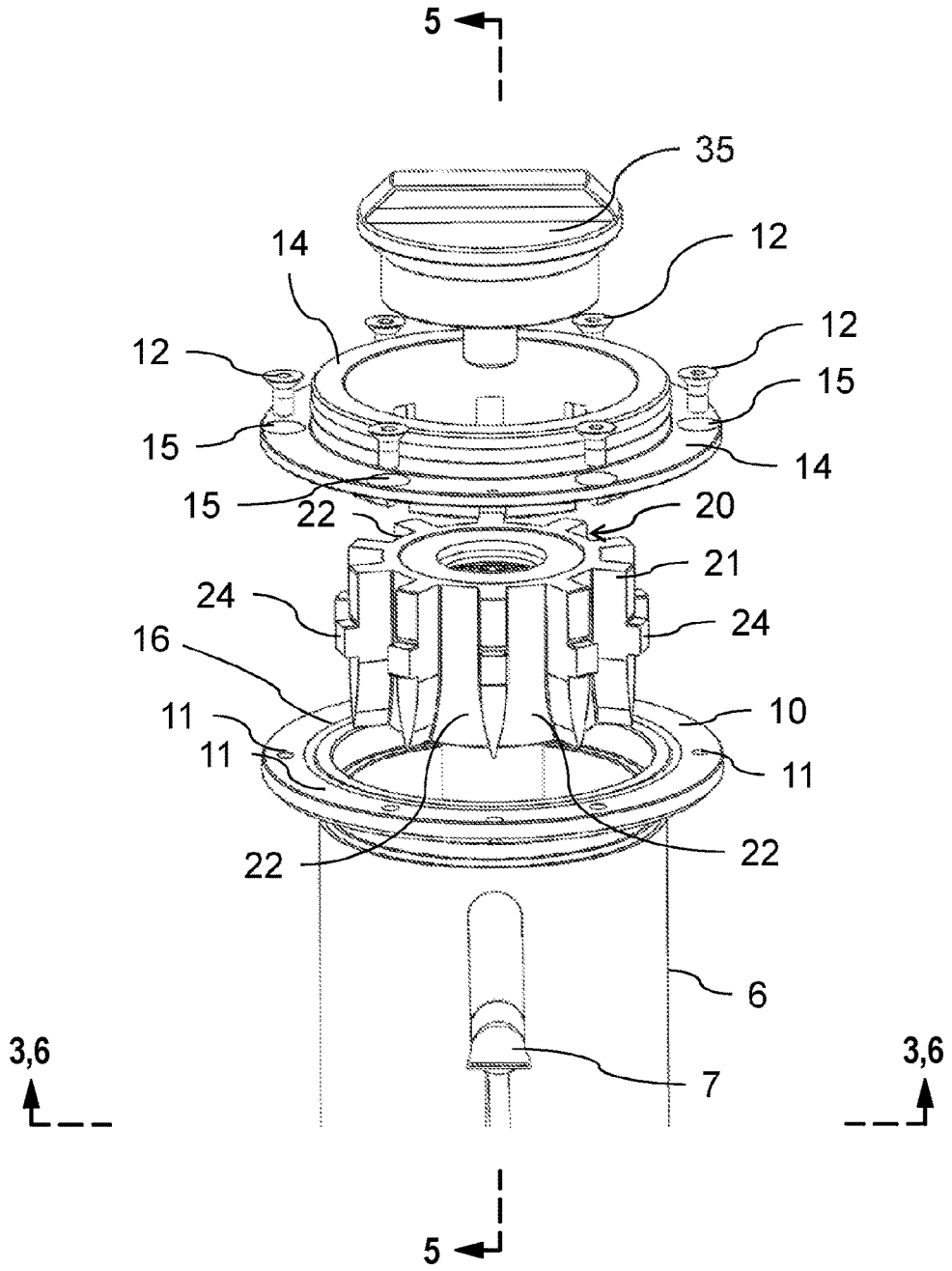
FIG. 2 is an exploded view of some members of the machine of FIG. 1.
Figure 3:
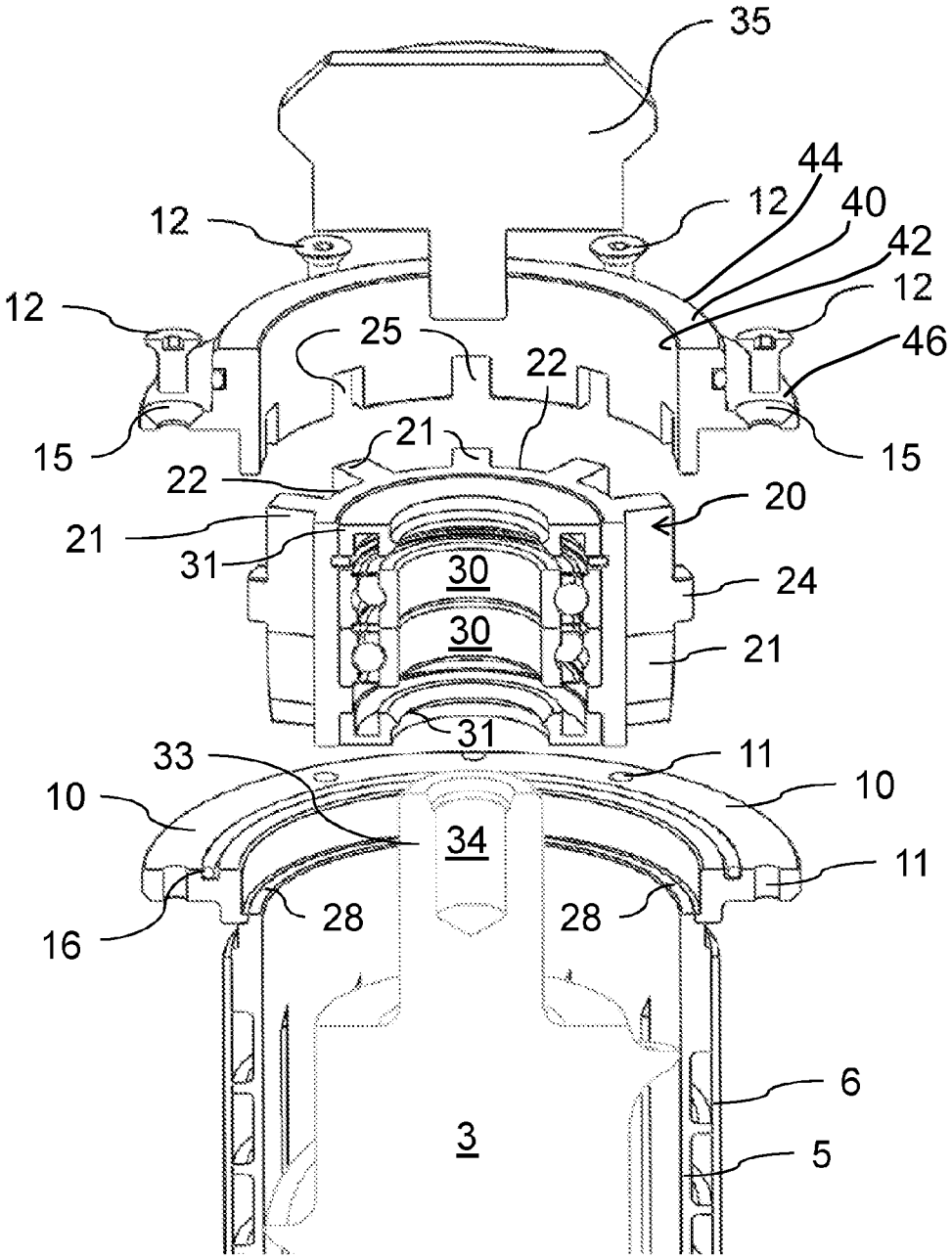
FIG. 3 is a cutaway exploded view of the members of FIG. 2.

With reference to the above listed drawings, an ice making machine according to the invention is generally shown by 1 therein, which is of the type with an evaporator with a vertical axis similar to that of the European patent mentioned above.

Therefore, for the sake of brevity in the present description, claims and drawings reference will be made to the upper part of such a machine, where the extrusion die is located, since this is the part of interest for the comprehension of the invention, while the other members (namely those in the lower part) will be not considered, because they are of the type known from the prior art and reference should be made thereto for further details.

Therefore the ice machine 1 comprises an evaporator generally denoted by the reference number 2, wherein an auger 3 operates for lifting water and for moving forward the ice formed on the inner walls of a main drum 4.

The latter, in the example shown in the drawings, is composed of a cylindircal wall outside which a coil 5 is obtained for flowing the refrigerant of the evaporator; such coil is enclosed in a liquid-tight manner by an outer cylindrical casing 6, coupled in a liquid-tight manner to the helical ribs such that the fluid can flow to the outside from a connection 7 located on the casing.

However other solutions can be provided for cooling the main drum of the evaporator, according to what already known in the art.

In the upper part of the ice making machine 1 the ice extrusion die is housed which will be better explained later, while now it has to be noted how the ice particles (granules, flakes or other) are gathered into a collector 8 from where they are discharged by gravity at a discharging outlet 9.

According to the invention, the upper edge of the casing 6 of the evaporator ends by a flange 10 provided with a series of holes 11 for fastening screws 12. The flange 10 is intended for the application of a ring 14 for fastening the ice extrusion die 20 that is also provided with holes 15 for the screws 12. More specifically, ring 14 comprises an annular wall 40 having an inside face 42 and an opposing outside face 44. A plurality of radially spaced apart seats 25 extend through a lower end of wall 40 between inside face 42 and outside face 44. An annular flange 46 radially outwardly projects from outside face 44 of wall 40. Holes 15 extend through flange 46.

The liquid-tight fitting between the flange 10 and the flange 46 of ring 14 is guaranteed by a ring gasket 16 made of rubber, teflon or another appropriate material.

The die 20 is provided with a plurality of teeth 21 extended lengthwise thereof, wherein the upstream end (that is the one towards the auger) with reference to the forward movement of the ice, is tapered while the downstream end is truncated, such to define the ice passage channels 22 having a section substantially decreasing from entrance to exit.

According to the invention, projections or appendages 24 are provided on the teeth 21 of the die, that in the example shown in the drawings, have a parallelepiped configuration but they can have even other shapes, for example a prismatic, cylindrical shape or a more complex one (a lobe, star like shape and the like).

Figure 4:
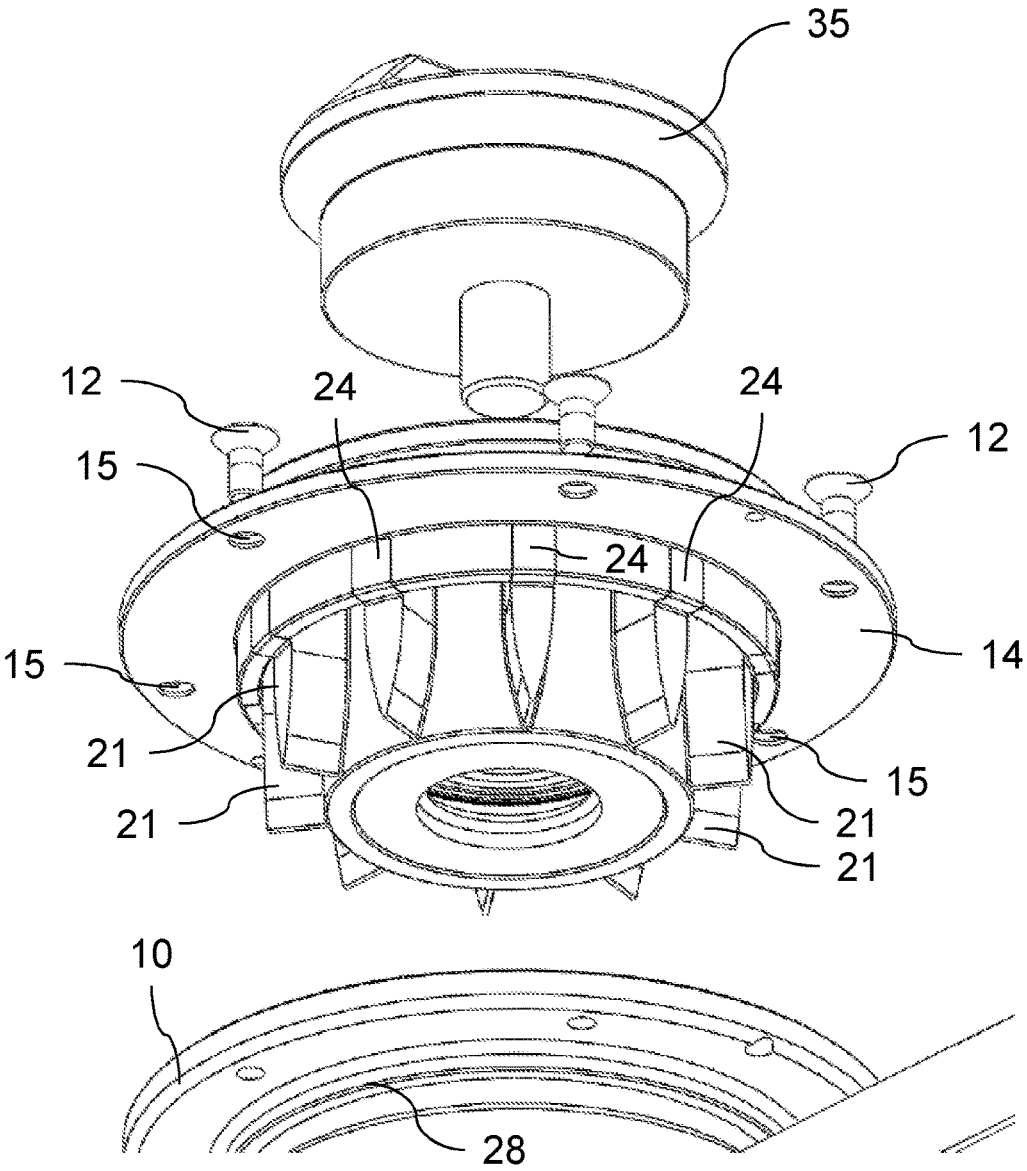
FIG. 4 is an exploded view of the members of the previous figures, taken from a different angle.
Figure 5:
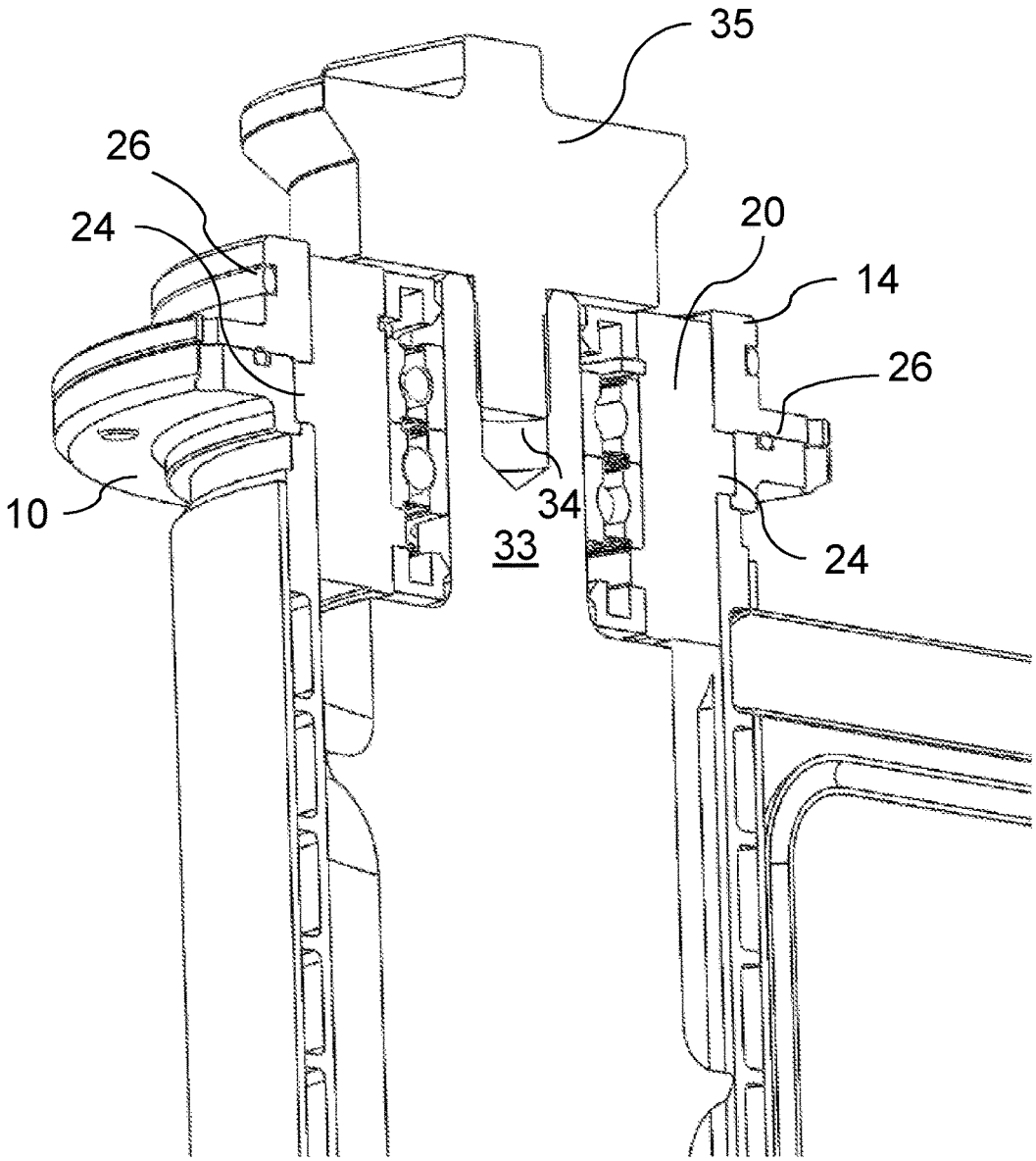
FIG. 5 is a cutaway view of the machine of the previous figures, in the assembled condition.
Figure 6:
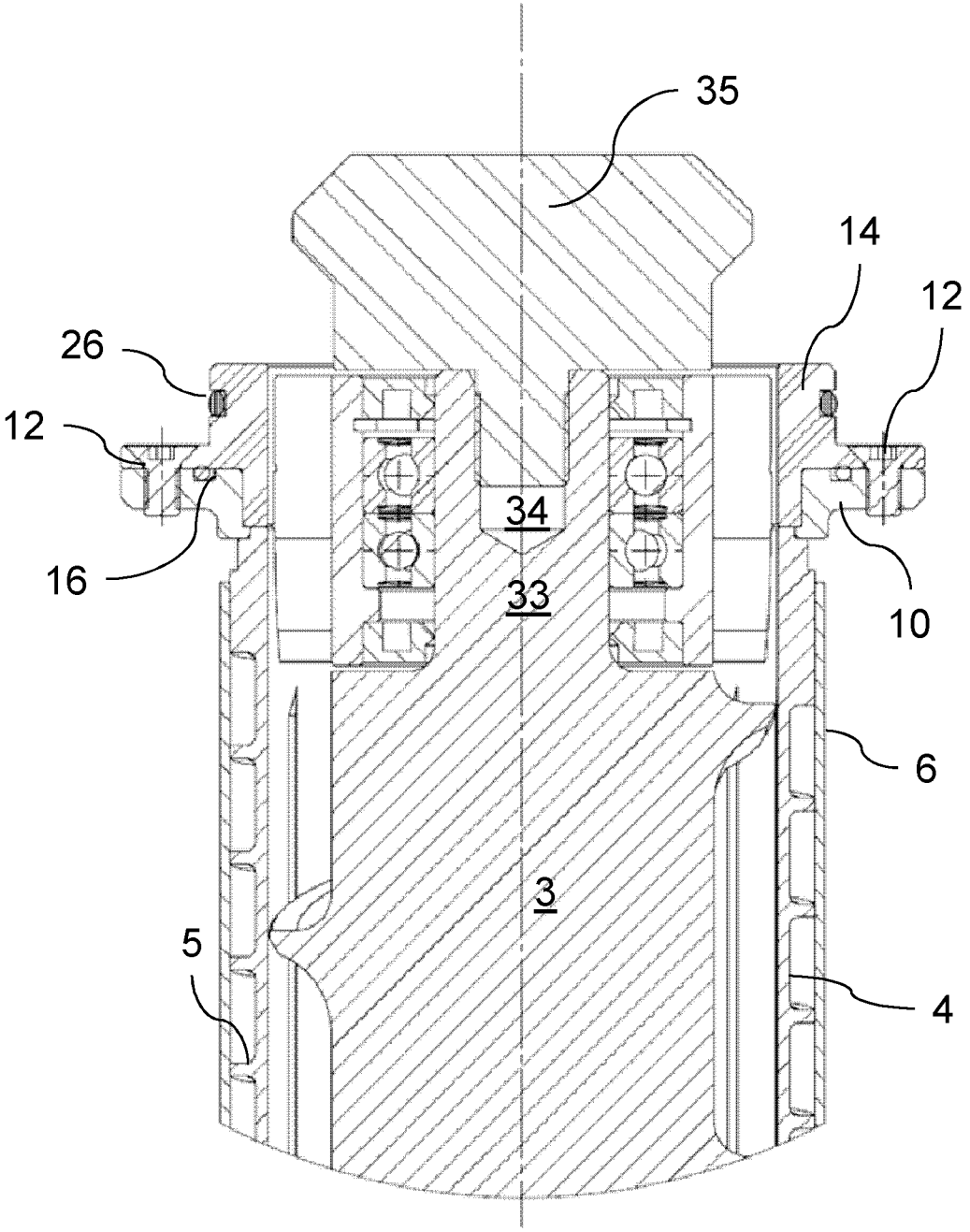
FIG. 6 is a sectional view in broken lines for a better comprehension of the assembled parts of the ice machine of the previous figures.

Such projections 24 engage into corresponding seats 25 arranged on the ring 14 fastening the die (see FIG. 4); moreover, the radial projections 24 of the die act also as an abutment for the die to rest against a shoulder 28, which is radially internal with respect to the flange 10 of the evaporator casing.

Thus it is easy to understand how the assembly of the die is easy to be performed, since it is fitted in the evaporator 2 after the auger 3, without the need of particular supporting means since it directly abuts against the shoulder 28 that defines its exact position with respect to the auger and the flange.

As it can be seen in the figures, bearings 30 are fitted inside the die 20 which are protected by suitable gaskets 31 known per se (preferably made of teflon or other material resistant to low operating temperatures and waterproof), such to allow the pin 33 of the auger 33 to freely move.

The pin 33 is advantageously provided with a threaded axial hole 34 for screwing on it a ice-breaking head 35: to this end the latter has a profile radially projecting with respect to the vertical axis of rotation of the auger 3, such as to deviate the rods of ice towards the collector 8, as it will be better explained below with reference to the operation of the invention.

For a better comprehension it is better to begin with the assembling phase of the extrusion die 20 into the evaporator 2.

After having fitted the auger 3 into the casing 4 of the evaporator, the die 20 with the bearings 30 and gaskets 31 previously arranged therein is fitted on the projecting pin 33 of the auger; this operation can be done manually and the die is fitted till its projections 24 abut against the shoulder 28 of the main drum of the evaporator 5.

Now it is possible to apply the ring 14 by pressing it from above and by coinciding the seats 25 with the projections 24, such to substantially obtain a single body of the ring with the die.

By aligning the holes 15 of the ring 14 with those 11 of the flange 10, it is possible to fasten the former to the latter by means of the screws 12 with the highest simplicity and accuracy.

In such condition the die 20 is clamped and therefore it is possible to complete the assembly of the ice making machine 1, by screwing the rod-breaking head 35 on the pin of the auger 33; this operations comes before the one fitting the ice collector 8, that in this example is simply coupled to the outside of the ring 14, with which it is preferably sealed by means of a sealing ring 26.

As regards the ice making operation, in the machine according to the invention the auger 3 lifts the water fed from below (in the area not shown in the figures), leading the ice to be formed as the water exchanges heat with the inner wall of the main barrel 4 of the evaporator.

Therefore the ice formed in this manner is pushed by the auger 3 to the die 20, wheren it is compressed by passing through the channels 22 with a decreasing section, forming rods that are then broken by the head 35.

At the outlet 9 of the machine 1 the ice is therefore shaped in pieces with dimensions that depend on the width of the channels 22 of the die and on the profile of the ice-breaking head 35, which can be different from a case to another one and which can be easily replaced by unscreweing it from the pin 33 of the auger 3.

The explanation of the operation of the ice making machine described above allows to understand how it solves the technical problem at the basis of the invention.

Firstly it has to be pointed out how the extrusion die is maintained in place, without any screws or any other radial fastening members penetrating through the main barrel 4 of the evaporator; thus it is intact in its structure since there are no screws passing therethrough.

Thus the drawbacks mentioned above with reference to the prior art set forth are solved.

Such advantageous result is further enhanced by the fact that the die 20 is maintained in place in the ice making machine according to the invention, without the help of fastening screws penetrating therein.

This prevents any differential thermal deformations between screws and die from occurring, that otherwise would cause the screws to be damaged or however would cause them to be loosened with the die being consequently unstable.

With reference thereto it has to be pointed out how the radial projections 24 of the teeth 21 of the die allowing it to be secured, are secured between the seats 25 of the ring 14 and the shoulder 28 of the casing 4 of the evaporator, but they are free with respect to the inner wall thereof such that differential thermal expansions, if any, between it and the die, can be compensanted by the existing clearances.

Above all it has to be pointed out that all these advantageous effects are achieved by a system for assembling the die into the evaporator that is particularly simple and efficacious, allowing it to be removed and replaced in a short time without the need for qualified personnel or equipment.

In order to remove the die it is sufficient to perform the assembling phases explained above in the reverse manner, that is to say firstly the collector 8 and the ice-breaking head 35 are removed, the latter by unscrewing it from the pin 33 of the auger 3.

Then the fastening ring 14 with the relevant screws 12 is removed from the flange 10, thus a quick access is provided to the upper part of the machine 1 where the die 20 is located, which can be easily withdrawn from the pin 33.

The fact that the disassembling is easy, it is not only advantgeous for the maintenance operations of the machine 1, but above all for the possibilty of changing the configuration of the produced ice and the size thereof, by changing the die 20 or the ice-breaking head 35.

According to the invention it is possible to change different ice extrusion dies depending on the type of ice to be produced.

Thus, for example, the die shown in the drawings can be replaced by dies having teeth with different dimensions and different in number, or by other ones having helically inclined teeth like those of toothed wheels of gears; thus it will be possible to achieve sizes of the ice with different dimensions, both straight and twisted ones, which can be broken with a head 35 similar to that shown in the drawings or a different one, depending on the desired shape of the ice (granules, or flakes or other types).

With reference thereto it is possible to use ice-breaking heads provided with arms inclined in a conical configuration, or radially projecting from the head, or heads with blade-like projecting edges intended to break the ice rods like the blades of a fan wheel for ventilation machines.

Obviously other variants to the invention are further possible with respect to those described up to now; for example, as regards the configuration of the ring 14 and of the flange 10 fastening the die, changes can be made.

One of them consists in exchanging the position of the seats 25, arranging them on the flange instead of the ring, therefore leaving the latter with an annular smooth edge; that is substantially it consists in changing the profile of the ring with that of the flange and vice versa.

Moreover, with reference to what explained above, the shapes and the extension of the teeth 21 of the die 20, and of the radial projections 24, can be different as regards the geometry with respect to those shown; thus, by way of example, the projections can have prismatic, conical, spherical shapes or shapes with even more complex geometries (lobe, star etc.).

Moreover it is understandable that it is possible not to provide the projections 24 on all the teeth 21: for example projections can be provided on alternate teeth, that is not consecutive ones, or on a pair of teeth placed diametrically opposite one another; similarly it is possible to have even several projections on each teeth.

It has to be pointed out how the principles of the invention can be applied generally to the machines for making extruded ice.

This means that machines can have also a horizontal axis, or can have other systems for moving the water and the ice forward instead of the auger; for example think of evaporators where water is sprayed by means of nozzles against the inner cooled wall of a casing of the evaporator, and the ice is scraped by means of scraper blade equipment.

However all these variants fall within the spirit of the following claims.

The invention claimed is:

1. An ice making machine comprising:

an evaporator comprising a drum, a flange that encircles and radially outwardly projects from the drum and a shoulder that is disposed radially inward of the flange, the shoulder comprising a flat, annular surface, the drum at least partially bounding a compartment, a die for extruding ice formed in the drum of the evaporator, wherein the die is secured to the drum without screws extending between the die and the drum, the die comprising:

a plurality of teeth each having an elongated length, and at least one projection that radially protrudes from at least one of the plurality of teeth at an intermediate position along the elongated length of the at least one of the plurality of teeth, the at least one projection being disposed within the compartment of the drum and resting on top of the flat, annular surface of the shoulder of the evaporator, and a ring member having a seat formed thereon on the ring member, the ring member being removably fastened to an end of the drum so as to secure the die to the drum, the at least one projection being received within the seat of the ring member, wherein the ring member comprises an annular wall, a flange outwardly extending from the annular wall, and the seat being formed on the annular wall, the flange of the ring being removably secured to the flange of the evaporator with the at least one projection of the die being received within the seat formed on the annular wall of the ring member, at least a portion of the annular wall of the ring member being disposed within the compartment of the drum.

2. The ice making machine according to claim 1, wherein the ring member is removably fastened to the flange of the evaporator.

3. The ice making machine according to claim 1, further comprising an auger housed into the drum, the auger being provided with a pin at one end thereof of the auger passing inside the die.

4. The ice making machine according to claim 3, further comprising an ice-breaking head removably coupled to the pin of the auger.

5. The ice making machine according to claim 1, wherein the at least one projection is fully disposed within the compartment of the drum.

6. The ice making machine according to claim 1, wherein the annular wall of the ring member rests on the shoulder of the evaporator.

7. The ice making machine according to claim 1, wherein each of the plurality of teeth is elongated having a first end and an opposing second end, the at least one projection being centrally disposed on the at least one of the plurality of teeth so as to be spaced apart from the first end and the opposing second end of the at least one of the plurality of teeth.

8. The ice making machine according to claim 7, wherein the at least one projection is fully disposed within the compartment of the drum.

9. The ice making machine according to claim 1, wherein the annular wall has an inside face and an opposing outside face, the flange of the ring member outwardly extending from the outside face of the annular wall, at least a portion of the seat extending through the annular wall between the inside face and the outside face at a location spaced apart from the flange of the ring member.

10. The ice making machine according to claim 1, wherein the flange of the evaporator has a top surface that faces the ring member and an opposing bottom surface, at least a portion of the wall of the ring member projecting below the top surface of the flange of the evaporator toward the bottom surface.

11. The ice making machine according to claim 1, wherein the at least one projection comprises a plurality of projections, each of the plurality of projections radially outwardly extending from a corresponding one of the plurality of teeth and resting on the shoulder of the evaporator.

12. The ice making machine according to claim 11, further comprising a plurality of seats formed on the annular wall of the ring member, each of the plurality of projections being received within a corresponding one of the plurality of seats.

13. The ice making machine according to claim 1, further comprising at least one screw securing the flange of the evaporator to the flange of the ring member.

14. The ice making machine according to claim 1, wherein the annular wall of the ring member is horizontally aligned with and is disposed radially inward from the flange of the evaporator.

15. The ice making machine according to claim 1, wherein the annular wall has a first end and an opposing second end, the flange of the ring member being centrally disposed on the annular wall so as to be spaced apart from the first end and the opposing second end of the annular wall.

* * * * *